US010217447B2

(12) United States Patent
Wunderlich

(10) Patent No.: US 10,217,447 B2
(45) Date of Patent: Feb. 26, 2019

(54) HAND DRUM AND METHODS OF USE

(71) Applicant: Jon M. Wunderlich, Lawrenceville, GA (US)

(72) Inventor: Jon M. Wunderlich, Lawrenceville, GA (US)

( * ) Notice: Subject to any disclaimer, the term of this patent is extended or adjusted under 35 U.S.C. 154(b) by 0 days.

(21) Appl. No.: 15/711,735

(22) Filed: Sep. 21, 2017

(65) Prior Publication Data

US 2018/0082666 A1 Mar. 22, 2018

Related U.S. Application Data

(60) Provisional application No. 62/397,548, filed on Sep. 21, 2016.

(51) Int. Cl.
*G10D 13/02* (2006.01)
*G10G 1/04* (2006.01)

(52) U.S. Cl.
CPC ..... *G10D 13/02* (2013.01); *G10G 1/04* (2013.01)

(58) Field of Classification Search
CPC ..... G10D 13/02; G10G 1/04
See application file for complete search history.

(56) References Cited

U.S. PATENT DOCUMENTS

| | | | | |
|---|---|---|---|---|
| 479,636 | A * | 7/1892 | Droop | G10D 13/006 84/422.1 |
| 729,936 | A * | 6/1903 | Heybeck | G10D 13/027 84/414 |
| 4,168,064 | A * | 9/1979 | Petrovic | A63B 60/40 473/466 |
| 4,469,001 | A * | 9/1984 | Hartry | G10D 13/027 264/342 R |
| 4,770,918 | A * | 9/1988 | Hayashi | B32B 5/12 428/113 |
| 4,976,651 | A * | 12/1990 | Frank | A63H 5/00 446/397 |
| 5,813,899 | A * | 9/1998 | Hartley | G10K 3/00 446/422 |
| 8,101,841 | B2 | 1/2012 | Hinrichs et al. | |
| 9,466,273 | B2 * | 10/2016 | Krol | G10D 13/025 |
| 9,669,323 | B2 * | 6/2017 | Raderman | A63H 5/00 |
| 9,756,846 | B2 * | 9/2017 | Burcham | A01M 31/004 |
| 10,019,975 | B2 * | 7/2018 | Di Cicco | G10D 13/06 |
| 2018/0082666 | A1 * | 3/2018 | Wunderlich | G10D 13/02 |

* cited by examiner

*Primary Examiner* — Robert W Horn
(74) *Attorney, Agent, or Firm* — Mathew L. Grell; Jeffrey C. Watson; Grell & Watson Patent Attorneys LLC

(57) ABSTRACT

A lightweight drum shell having two heads for a double-headed drum with a beater connected to an interior wall of the drum shell via a spring, and thus functions to provide a hand held shaker drum capable of producing complicated rhythms, such as varying frequency of beats, speed of beats, or meter especially when two bounce back drums are played together.

22 Claims, 6 Drawing Sheets

HAND DRUM AND METHODS OF USE

CROSS-REFERENCE TO RELATED APPLICATIONS

To the full extent permitted by law, the present United States Non-provisional Patent Application hereby claims priority to and the full benefit of U. S. Provisional Application entitled "BOUNCEBACK HAND DRUM," having assigned Ser. No. 62/397,548, filed on Sep. 21, 2016, incorporated herein by reference in its entirety.

FEDERALLY SPONSORED RESEARCH OR DEVELOPMENT

None

PARTIES TO A JOINT RESEARCH AGREEMENT

None

REFERENCE TO A SEQUENCE LISTING

None

BACKGROUND OF THE INVENTION

Technical Field of the Disclosure

This disclosure relates generally to a percussion instrument and, more specifically, to a hand held drum.

Description of the Related Art

Currently in the field of percussion instruments, those musical instruments which are usually struck, shook, or induce noise through friction include the tambourine, shaker, cabasa, bell, cymbal, LP one handed triangle and the like and such instruments are used to play music or create rhythms. However, these instruments are not drums and do not make drum sounds. Moreover, these instruments do not have a bouncing action that lets the player play off the bounce similar to how a guitarist plays off a delay. The LP one handed triangle does have a pivoting action but it is more rigid, rather than a more fluid motion which can reward the player with an unexpected bonus beat or two.

One previous drum includes those in a standard drum kit, such as bass drum, floor drum, snare drum, hanging/rack toms are drums characterized by the sound they create when their head is struck from the outside. Drums are usually played with drum sticks, but other beaters such as the brush or the rute can be used to achieve very different sounds. One disadvantage of this approach is that drums can only generate as complex a rhythmic pattern as the operator can generate through drum sticks and foot pedal.

Another previous drum includes the pellet drum or rattle drum are a class of drums characterized by their two head construction either a single double-headed drum or two hemispherical single-headed drums joined together with the heads facing outward, and two pellets, each connected by a cord to the outside of the drum or handle or multiple pellets placed loose inside the rattle drum. The drum is preferably attached to a vertical rod or handle, which is rotated back-and-forth between the palms causing the pellets to strike the outside surface of the drum heads generating a repeating sound or rattle. One disadvantage of this approach is that pellet or rattle drums can only generate a continuous rapid rhythm and that rhythm is fixed by the operators twisting speed and the length of cord.

Therefore, it is readily apparent there is a recognizable unmet need for a bounce back shaker drum and methods of use that may be configured to address at least some aspects of the problems discussed above common to the traditional percussion instruments, which specifically functions to provide a varying rhythms from a lightweight instrument with a bouncing action that lets the player play off the bounce and produce complicated rhythm patterns with ease. Rhythm patterns that may be very strenuous when played on the bongos, for instance, but alternatively may be played on the bounce back shaker drum with far less effort and fatigue.

SUMMARY

Briefly described, in an example embodiment, the present disclosure overcomes the above-mentioned disadvantages and meets the recognized need for a bounce back shaker drum and methods of use, which generally may include a lightweight drum shell having two heads for a double-headed drum with a beater connected to an interior wall of the drum shell via a spring, and thus functions to provide a hand held shaker drum capable of producing complicated rhythms, especially when two bounce back drums are played together. When two of these drums are played together, using the same wrist movements one would use when playing a conventional drum, complicated rhythms can be achieved with much less effort and fatigue.

According to its major aspects and broadly stated, the disclosure of the a bounce back shaker drum and methods of use, which generally may include a drum shell with a first opening or aperture having an upper or first rim and a second opening or aperture having a lower or second rim, two heads includes an upper or first head stretched across the first opening or aperture and affixed to the upper or first rim and lower or second head stretched across the second opening or aperture and affixed to the lower or second rim, a spring having a first end and a second end, the first end removeably affixed to an interior surface of the drum shell and the second end affixed to a beater.

In an exemplary embodiment, the bounce back shaker drum includes a drum shell having an external surface and internal surface and configured with one or more apertures, a spring mount affixed thereto the drum shell, a striker element, a spring having first spring end releasably affixed thereto the spring mount and a second spring end affixed to the striker element, and at least one head stretched taught across the one or more apertures.

In an exemplary embodiment of a method of generating a rhythm from a hand held drum, the method including the steps of providing a drum having a drum shell having an external surface and internal surface and configured with one or more apertures, a spring mount affixed thereto the drum shell, a striker element, a spring having first spring end releasably affixed thereto the spring mount and a second spring end affixed to the striker element, at least one head stretched taught across the one or more apertures, the at least one head having an inside head surface, gripping the drum, shaking the drum in an arc motion, wherein the striker element travels in an arc motion striking the inside head surface, and producing a drum beat on each strike of the striker element thereon the inside head surface.

Accordingly, a feature of the bounce back shaker drum and methods of use is the ability to play fast rhythms, such as 32nd note or 16th note triplets, or ¼ note, ⅛ note, 1/16 note, 1/32 note, drum roll, or the like with one hand. A drum roll can even be played with one hand, with some practice.

Another feature of the bounce back shaker drum and methods of use is the ability to combined play of the bounce back shaker drum with another instrument in the other hand and playing both together creating a very full sound. Moreover, playing two bounce back shaker drums provides a more balanced feel and is more like playing a realistic drum solo.

Still another feature of the bounce back shaker drum and methods of use is its ability to provide a handle to enable a user to grip the drum. The handle is designed so that the player can put gentle pressure on the heads with the thumb on the top head and the middle or index finger on the bottom head raising the pitch as the drum is being played. If no pressure is applied to the heads the drum plays a predetermined pitch based on the tension each head is mounted thereto the drum shell.

Yet another feature of the bounce back shaker drum and methods of use is the drum's ability to be played for long periods of time. Here, the bounce back shaker drum is a light weight instrument and the player can create complex patterns with a flick of the wrist without expending the energy necessary to play the same rhythms on another instrument, such as a bongo or conga.

Yet another feature of the bounce back shaker drum and methods of use is its ability to enable the instrument to be played while walking around, even with each hand operating a bounce back shaker drum the player can easily walk around and play at the same time. Unlike bongos, which must be held between the knees while sitting or mounted on a stand.

Yet another feature of the bounce back shaker drum and methods of use is its ability to enable a variety of inner changeable heads or skins used are a batter head (the playing surface of the drum) to control the volume and tone of the drum.

Yet another feature of the bounce back shaker drum and methods of use is its ability to enable a variety of different springs (length, cross-section, and flexibility) to control rhythm, speed and meter of the drum. It is recognized herein that a metal rectangular cross-section elongated member has proved to be a reliable and consistent spring.

Yet another feature of the bounce back shaker drum and methods of use is its ability to enable a variety of drum shell shapes, configurations, and material to control volume, and tone of the drum.

Yet another feature of the bounce back shaker drum and methods of use is its ability to provide a hand held shaker drum capable of producing varying frequency of beats, speed of beats, or meter including high frequency with a bouncing beater action that lets the player play off the bounce and allow a more fluid motion which can reward the player with an unexpected bonus beat or two. For example, as long as the bounce back shaker drum is being played in time the bonus beat will be in time also. If the bounce back shaker drum is held at a more vertical angle, and shaken back and forth with an even motion, the drum may play a perfect triplet. This can be controlled by returning the bounce back shaker drum to a diagonal angle again.

These and other features of the bounce back shaker drum and methods of use will become more apparent to one skilled in the art from the prior Summary and following Brief Description of the Drawings, Detailed Description of exemplary embodiments thereof, and Claims when read in light of the accompanying Drawings or Figures.

BRIEF DESCRIPTION OF THE DRAWINGS

The present bounce back shaker drum and methods of use will be better understood by reading the Detailed Description of the Preferred and Selected Alternate Embodiments with reference to the accompanying drawing Figures, in which like reference numerals denote similar structure and refer to like elements throughout, and in which.

DETAILED DESCRIPTION

In describing the exemplary embodiments of the present disclosure, as illustrated in FIGS. 1-3, 4A, 4B, and 5 specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Figure 1:
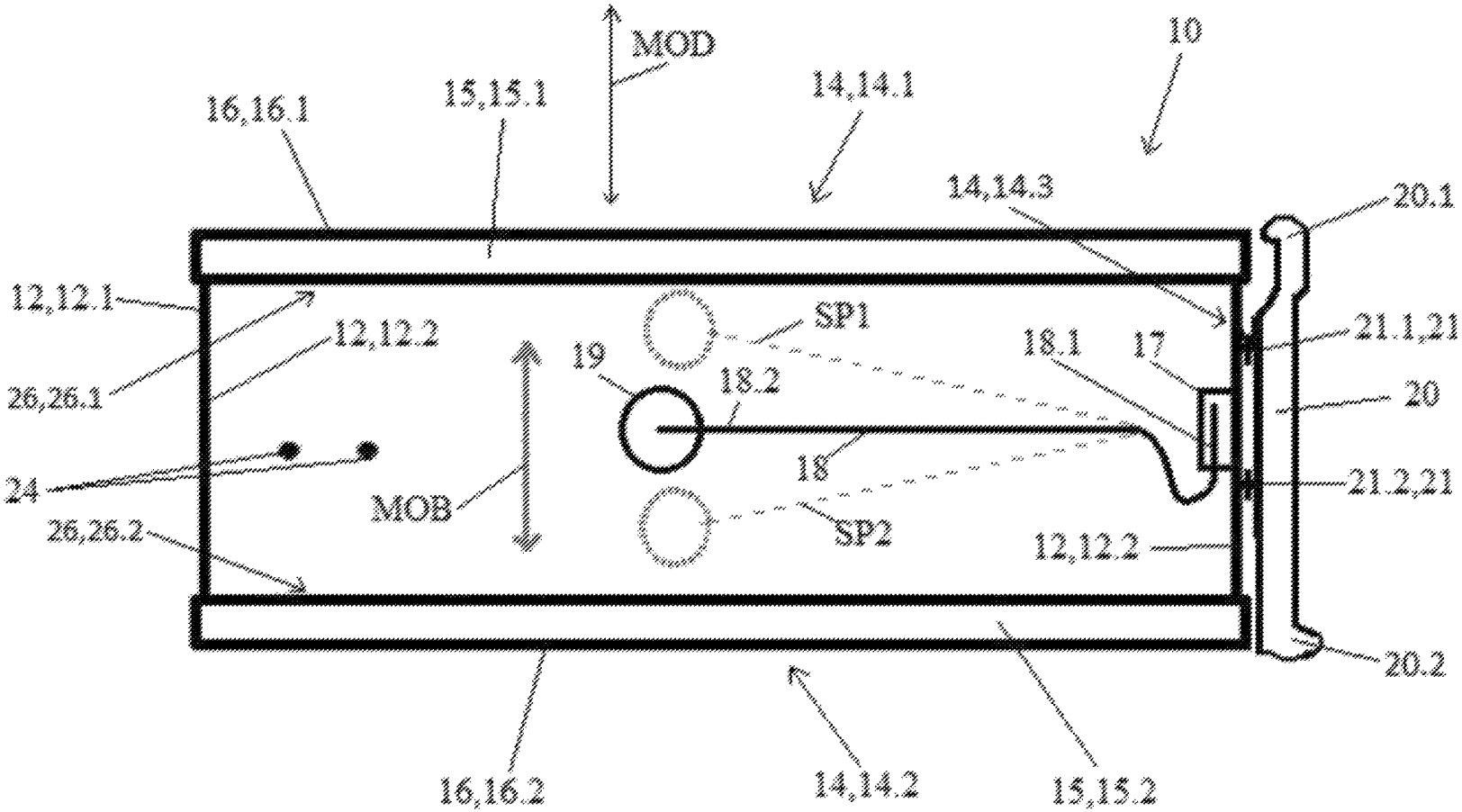
FIG. 1 is a cross-sectional side view of an exemplary embodiment of the bounce back shaker drum, shown assembled.
Figure 2:
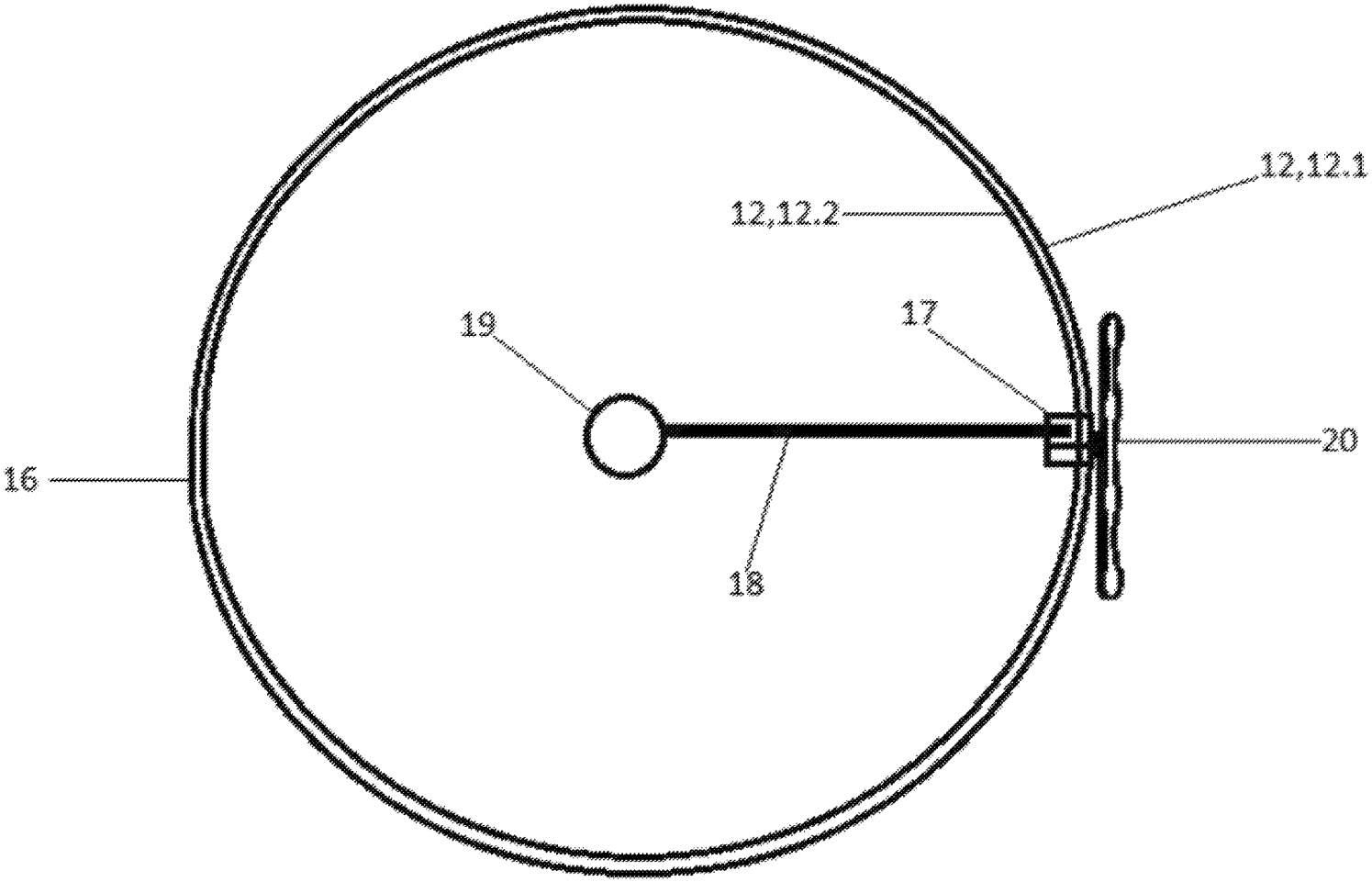
FIG. 2 is a cross-sectional top view of an exemplary embodiment of FIG. 1.

Referring now to the FIGS. 1 and 2 there is illustrated an exemplary embodiment of the bounce back shaker drum 10 preferably configured as a multi-piece fabricated and assembled drum having a structure formed as a cylinder, conduit or the like, such as drum shell 12 having external surface 12.1 and internal surface 12.2 and configured with one or more shell holes or apertures 14 therein drum shell 12, such as top or first shell opening 14.1 with an opening, perimeter, edge, or upper rim, such as top or first rim 15.1 and bottom or second shell opening 14.2 with an opening, perimeter, edge, or lower rim, such as bottom or second rim 15.2.

It is contemplated herein that drum shell 12 and other parts or elements herein may be made from various wood, metal, acrylic, composite, or reinforced composite fibers e.g., fiberglass materials. It is contemplated herein that other suitable materials may be utilized or the like, whether formed of different materials, or the like, may be utilized, provided such material has sufficient strength, rigidity, acoustic resonance, tone and load bearing properties durability, chemical resistance, offers long service life, pH tolerance, light weight, and/or durable as would meet the purpose described herein. Moreover, drum shell 12 may be formed of plies or layers of material that are affixed with an adhesive, heat bonded, or compression molded into cylinder, conduit or the like. Steam or moisture bent drum shell 12 may be formed of one ply of wood that is gradually rounded into a cylinder and glued at one seam. Segment shells are made of multiple stacks of segmented wood rings. Furthermore, drum shell 12 may be formed round or ring segments of material bonded together via an adhesive into a cylinder, conduit or the like and rounded out by a lathe to form drum shell 12. Similarly, drum shell 12 may be formed from vertical segments of material bonded together via an adhesive into a cylinder (like a barrel) and rounded out by a lathe to form drum shell 12. A solid shell of drum shell 12 may be formed of one solid piece of material and machined or hand tool hollowed to form cylinder, conduit or the like.

It is further contemplated herein that drum shell 12 may include one or more shell holes, such as air and sound holes 24 positioned therethrough drum shell 12 to enable air pressure and sound waves to escape drum shell 12.

It is still further contemplated herein that as top or first rim 15.1 and bottom or second rim 15.2 may be configured as reinforcement rings, and may be configured or affixed thereto affixed thereto internal surface 12.2 of drum shell 12, affixed thereto external surface 12.1 of drum shell 12, or affixed thereto top or first rim 15.1 and bottom or second rim 15.2 of drum shell 12 to maintain the shape of drum shell 12, such as round.

A typical diameter for drum shell 12 may be approximately six (6") or eight (8") and external surface 12.1 and internal surface 12.2 may have a width of approximately three (3"); however other dimensions are contemplated herein.

Preferably, bounce back shaker drum 10 may include a bracket, support, or stay, such as spring mount 17 affixed thereto drum shell 12 or internal surface 12.2 of drum shell 12. Moreover, bounce back shaker drum 10 may include a biasing element or device, such as spring 18 having first spring end 18.1 preferably releasably affixed thereto spring mount 17 and may include second spring end 18.2 affixed to a striker element, such as beater 19. Furthermore, spring 18 may include a u-shaped or other shaped bend formed therein first spring end 18.1. It is recognized herein that u-shaped or other shaped bend formed therein spring 18 may provide better flexibility to, first spring end 18.1 or spring 18 and may make it easier to mount first spring end 18.1 thereto spring mount 17 as well.

It is contemplated herein that spring mount 17 may include a mechanical attachment device to enable a length adjustment or distance adjustment between beater 19 and internal surface 12.2 of drum shell 12. It is recognized herein that adjustment or distance adjustment between beater 19 and internal surface 12.2 of drum shell 12 may be used to vary the speed or meter of the drum beats.

It is further contemplated herein that spring 18 may vary in length, strength, flexibility, elasticity, springiness, stiffness, or the like and materials with these qualities to accommodate a variety of rhythms, speeds or meters emanating therefrom bounce back shaker drum 10.

It is still further contemplated herein that beater 19 may be formed of a hard material, such as hard rubber, plastic, wood or the like to generate a variety of sounds, tones, or pitch emanating therefrom bounce back shaker drum 10.

Moreover, one or more shell holes or apertures 14 of bounce back shaker drum 10 may include one or more playing surface of the drum top, such as top or first head 16.1 may be stretched taught across first shell opening 14.1 and may be releasably affixed thereto first rim 15.1, and bottom or second head 16.2 may be stretched taught across second shell opening 14.2 and may be releasably affixed thereto second rim 15.2.

It is contemplated herein that top or first head 16.1 and bottom or second head 16.2 may be configured as soft heads or skins for practice play of bounce back shaker drum 10, and harder heads or skins for performance volume play of play of bounce back shaker drum 10.

It is further contemplated herein that top or first head 16.1 and bottom or second head 16.2 herein may be made from animal skins, such as goat or calf skin, however, most modern drums use plastic, such as Mylar skins of around 10 mils thickness, or alternatively sometimes made with multiple plies of around 7 mils to produce lower pitch and warmer sound or thinner skins of around 3 to 5 mils to produce high pitch, like a bongo.

Furthermore, bounce back shaker drum 10 may include a grip, handle or knob, such as handgrip 20 removeably or permanently affixed thereto drum shell 12. Preferably, drum shell 12 may include one or more shell holes or apertures 14 therethrough drum shell 12, such as side or third shell opening 14.3. Side or third shell opening 14.3 may be utilized to releasably affix one or more hardware connection device to removeably affix handgrip 20 thereto drum shell 12.

Figure 3:
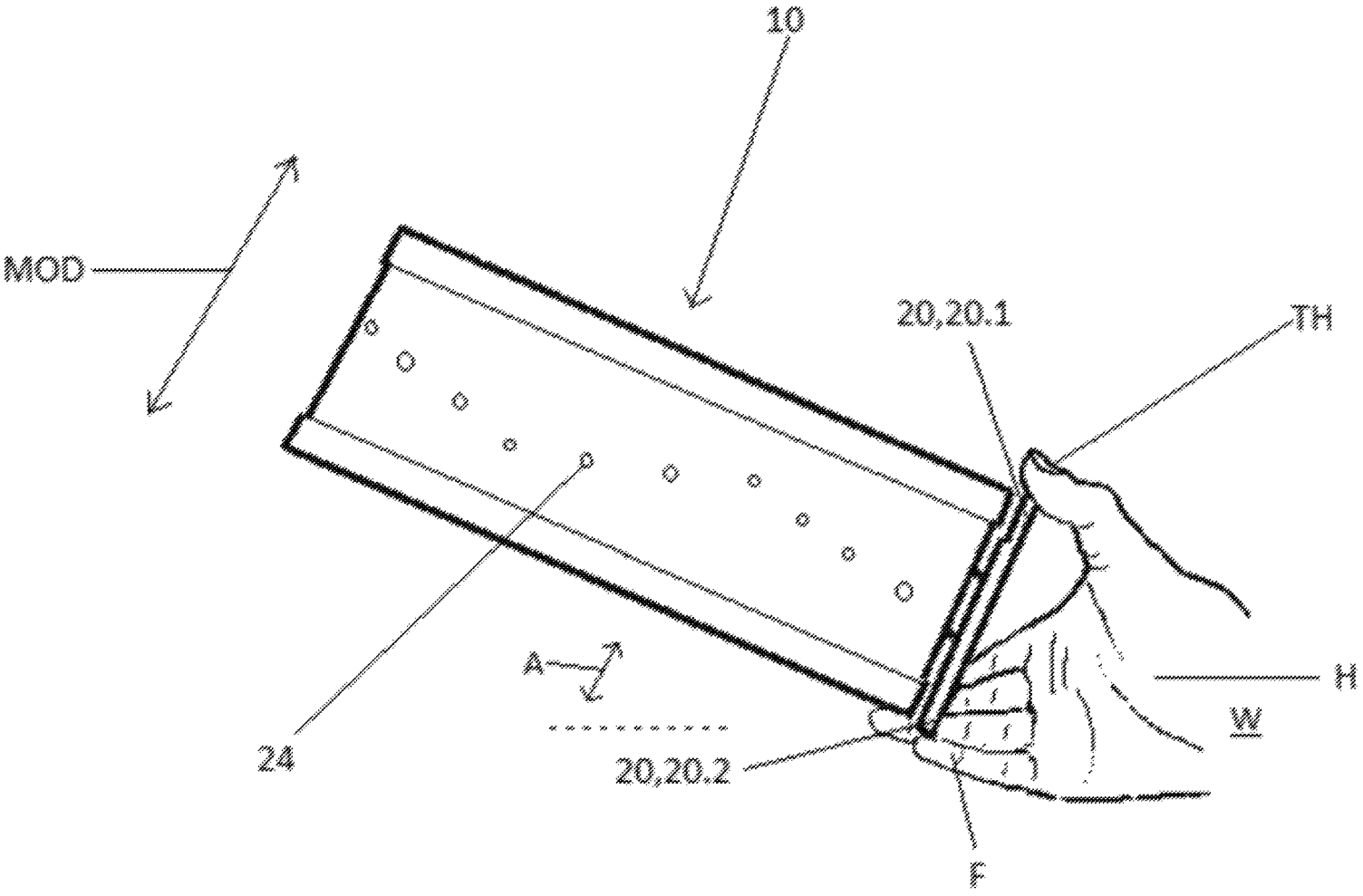
FIG. 3 is a side view of an exemplary embodiment of FIG. 1, shown in use.

Referring now to the FIG. 3 there is illustrated an exemplary embodiment of the bounce back shaker drum 10, shown in use being played as a percussion instrument. Preferably, a user grips handgrip 20 by placing user's thumb TH around first grip end 20.1 of handgrip 20 and one or more fingers F around second grip end 20.2 of handgrip 20 with user's thumb TH pointing up and user holding the drum at an angle or tilt, such as angle A (gripped). Furthermore, user may shake or move bounce back shaker drum in an arc or direction indicated by movement of drum MOD, and thus beater 19 may travel an arc or direction indicated by movement of beater MOB, shown in FIG. 1 inside bounce back shaker drum 10 striking or bouncing back and forth from first spring position SP1 to second spring position SP2 along arc or direction indicated by movement of beater MOB striking top or first head 16.1 and bottom or second head 16.2, repeatedly. In use, thumb Th facing up the wrist is snapped forward and downward to generate movement of drum MOD of bounce back shaker drum 10 preferably generates a drum beat on each strike of beater 19 thereon inside surface 26 of skin or head 16, such as top or first inside head surface 26.1 and bottom or second inside head surface 26.2, thus creating a variety of sounds, tones, or pitch emanating therefrom bounce back shaker drum 10, including ability to play fast rhythms, such as 32nd note or 16th note triplets, or ¼ note, ⅛ note, 1/16 note, 1/32 note, a drum roll, or the like with one hand. A drum roll can even be played with one hand, with some practice.

It is contemplated herein that when beater 19 gets moving between first spring position SP1 to second spring position SP2 along arc or direction indicated by movement of beater MOB, beater 19 actually bounces by itself and with practice the player learns how to control it with light flicks of the wrist.

It is further contemplated herein that two bounce back shaker drums 10 may be played by one operator or user at the same time, one in each hand, with each hand playing against the other producing a different sound, tone, or pitch emanating therefrom each bounce back shaker drum 10. Moreover, bounce back shaker drums 10 may be played by one operator or user at the same time, one in each hand, with each hand playing together (on the same beat), for a more full sound.

It is still further contemplated herein that utilizing (softer), top or first head 16.1 and bottom or second head 16.2 the bounce back shaker drums 10 may be played without the sound bothering others anytime, day or night.

It is yet still further contemplated herein that shaking bounce back shaker drums 10 back and forth along an arc or direction indicated by movement of drum MOD wherein beater 19 strikes inside surface 26 of skin or head 16, such as top or first inside head surface 26.1 and bottom or second inside head surface 26.2, and bounces back and forth between the heads resulting in double strike(s) and bouncing action of beater 19, and thus enables or facilitates the player to create complex rhythms not achievable by any other single handed, hand held drum.

Figure 4A:
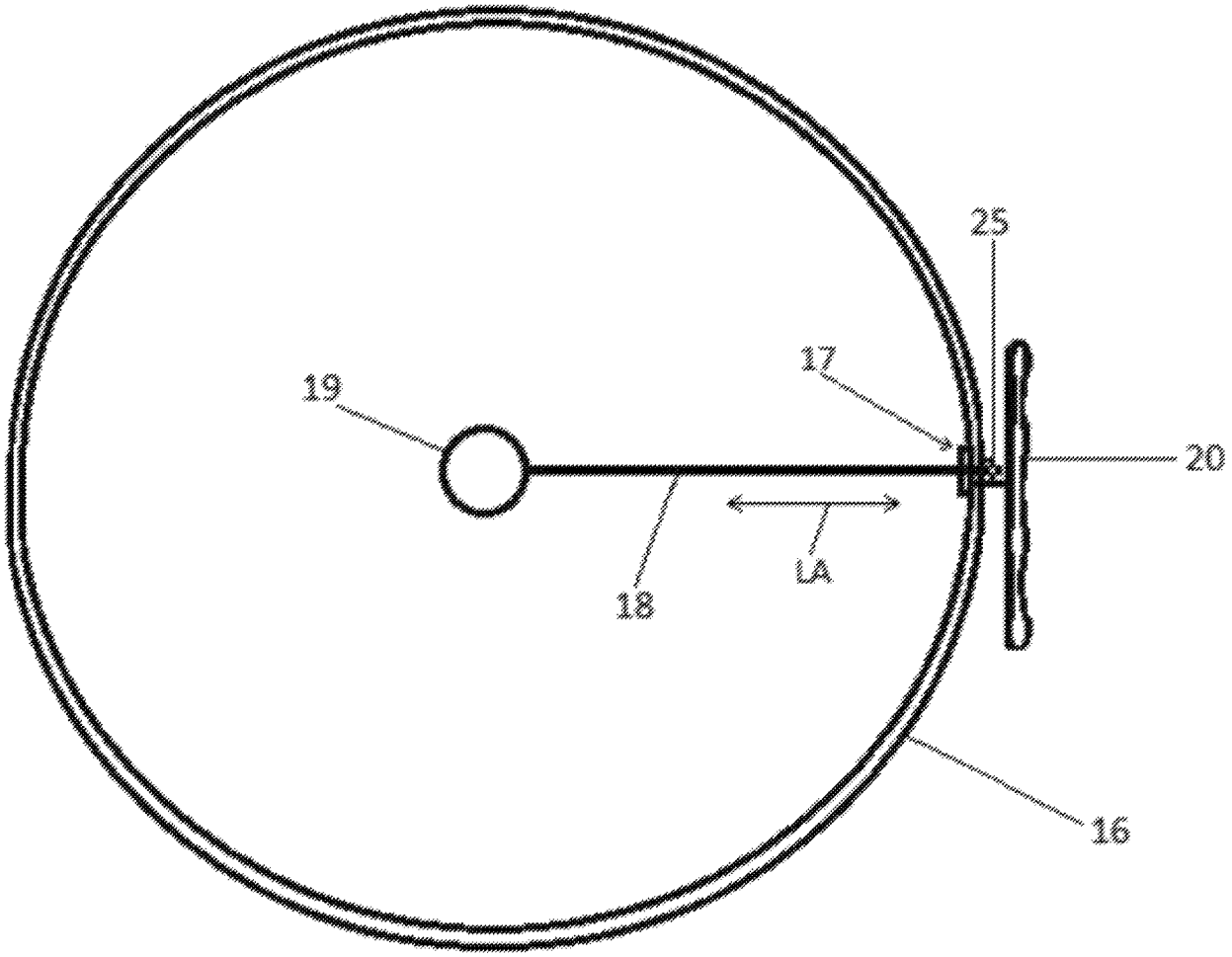
FIG. 4A is a cross-sectional top view of an alternate exemplary embodiment of the bounce back shaker drum, shown assembled.
Figure 4B:
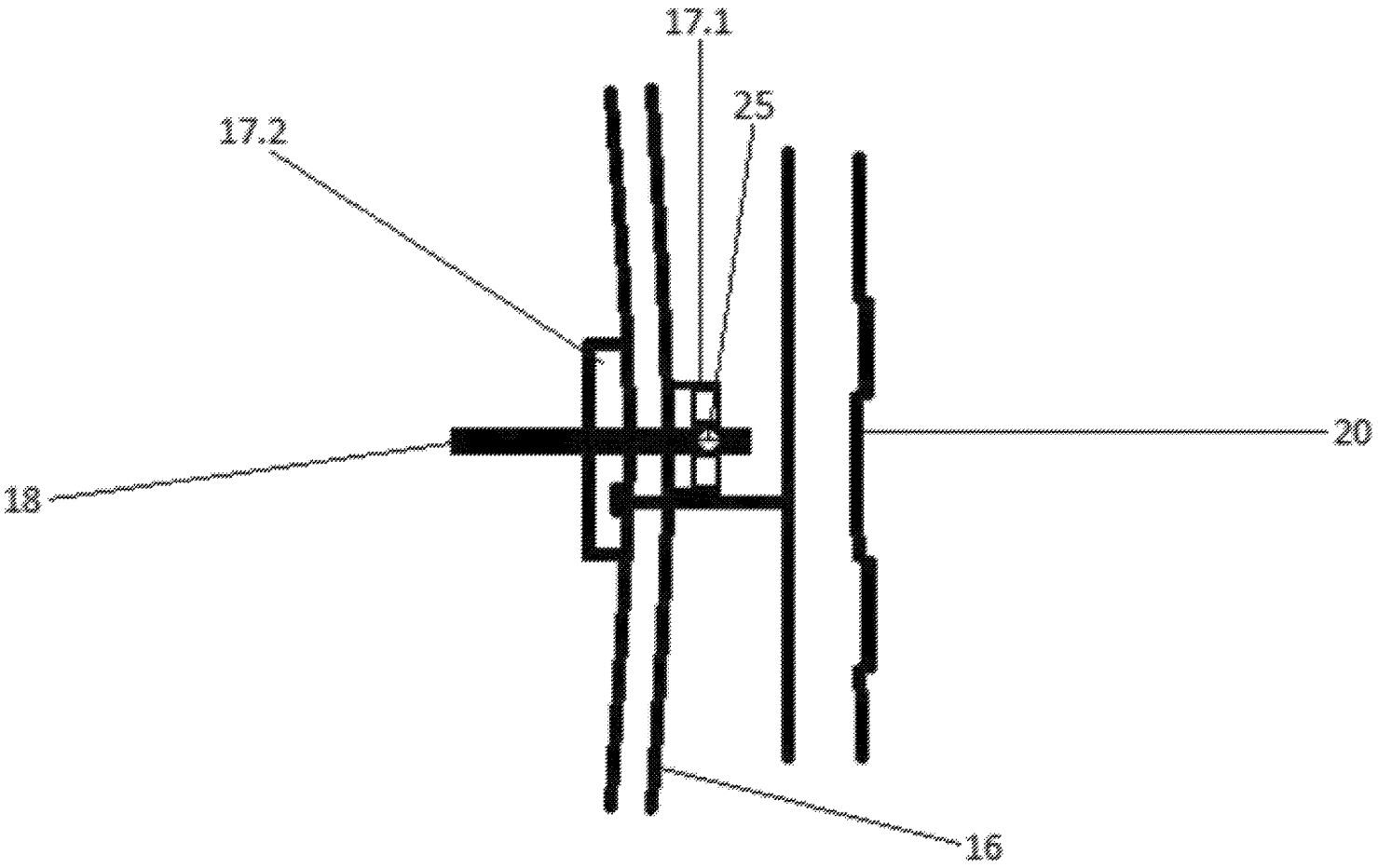
FIG. 4B is a partial cross-sectional side view of the alternate exemplary embodiment of FIG. 4A.

Referring now to the FIGS. 4A and 4B there is illustrated an alternate exemplary embodiment of the bounce back shaker drum 10 preferably configured as a multi-piece fabricated and assembled drum having a structure formed as a cylinder, conduit or the like, such as drum shell 12 having external surface 12.1 and internal surface 12.2 and may have only one head, bottom or second head 16.2 on the bottom of bounce back shaker drum 10. Preferably, bounce back shaker drum 10 may include a bracket, support, or stay, such as spring mount 17 affixed thereto internal surface 12.2 of drum shell 12. Moreover, bounce back shaker drum 10 may include a biasing element or device, such as spring 18 having first spring end 18.1 preferably releasably affixed thereto spring mount 17 and may include second spring end 18.2 affixed to a striker element, such as beater 19. Furthermore, spring mount 17 may include an external bracket, support, or stay, such as first spring mount 17.1 affixed to external surface 12.1 and internal bracket, support, or stay, such as second spring mount 17.2 affixed to internal surface 12.2 and configured to releasably affix first spring end 18.1 thereto drum shell 12. Moreover, spring mount 17 may include a mechanical adjustment device or adjustment mechanism, such as set screw 25 to enable a distance or linear adjustment, such as length adjustment LA between beater 19 and internal surface 12.2 of drum shell 12 via tightening and loosening set screw 25. In use, length adjustment LA of spring 18 between internal surface 12.2 of drum shell 12 enables or facilitates the player to create varying speed of beats to accommodate multiple meters and enable the player to play along with slow, medium, or fast songs. It is recognized herein that a single downward motion, movement of drum MOD, may cause beater 19 to bounce repeatedly on bottom or second head 16.2 only, and since there is no top or first head 16.1, the sound fades out as it repeats, just like an analog or digital delay used by a guitarist.

Furthermore, bounce back shaker drum 10 may include a grip, handle or knob, such as handgrip 20 removeably or permanently affixed thereto drum shell 12.

Figure 5:
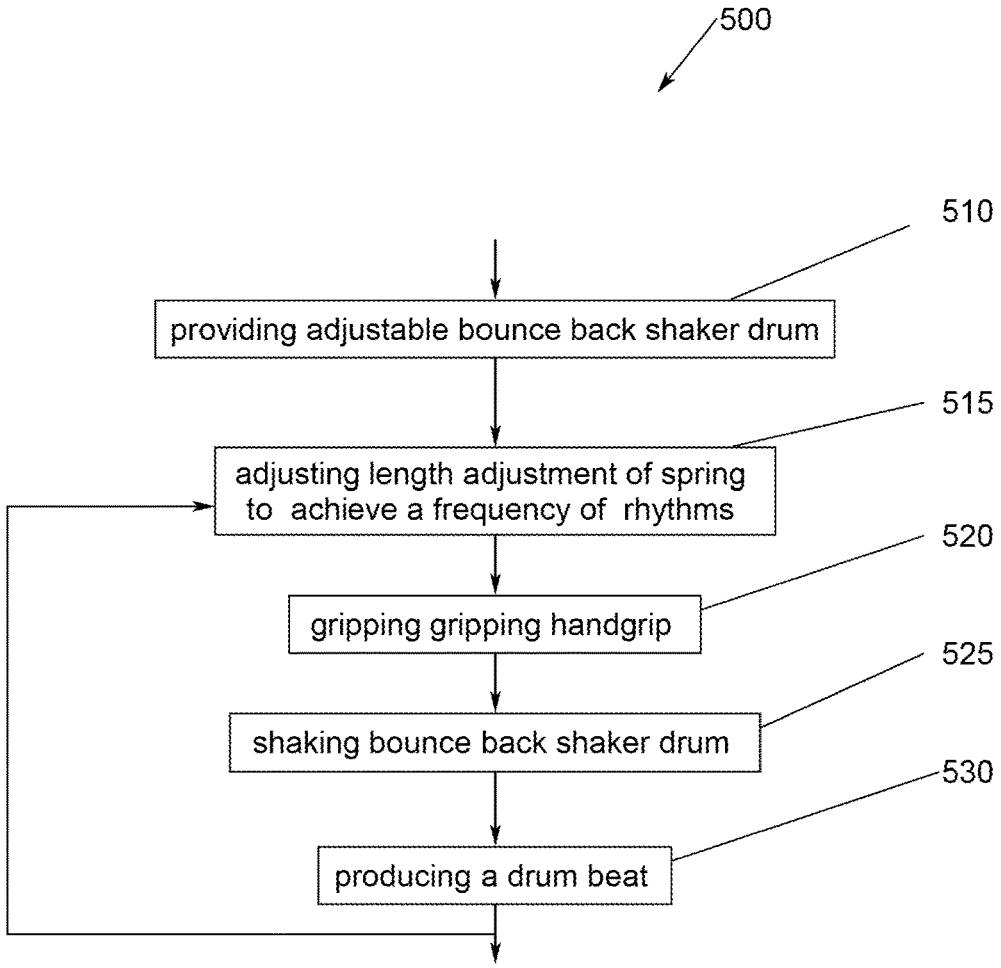
FIG. 5 is a flow diagram of a method of use of an exemplary embodiment of adjusting and playing bounce back shaker drum.

Referring now to FIG. 5, there is illustrated a flow diagram 500 of a method of use of an exemplary embodiment of bounce back shaker drum 10. In block or step 510, providing bounce back shaker drum 10 as set forth in any of the embodiments discussed herein, and/or shown in FIGS. 1-4. In block or step 515 adjusting length adjustment LA of spring 18 (linear) via mechanical adjustment device, such as set screw 25 to enable or facilitate the player to create varying speed of beats, or meter. In block or step 520 gripping handgrip 20 by preferably placing user's thumb TH around first end 20.1 of handgrip 20 and one or more fingers F around second end 20.2 of handgrip 20 with user's thumb TH pointing up and user holding the drum at an angle or tilt, such as angle A. In block or step 525, shaking bounce back shaker drum 10 in an arc or direction indicated by movement of drum MOD and thus beater 19 may travel in an arc or direction indicated by movement of beater MOB between first inside head surface 26.1 and bottom or second inside head surface 26.2. In block or step 530, producing a drum beat on each strike of beater 19 thereon inside head surface 26 of skin or head 16, such as top or first inside head surface 26.1 and bottom or second inside head surface 26.2, thus creating a variety of sounds, frequencies, tones, or pitch emanating therefrom bounce back shaker drum 10.

The foregoing description and drawings comprise illustrative embodiments of the present disclosure. Having thus described exemplary embodiments, it should be noted by those ordinarily skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments of the disclosure will come to mind to one ordinarily skilled in the art to which this disclosure pertains having the benefit of the teachings presented in the foregoing descriptions and the associated drawings. Although specific terms may be employed herein, they are used in a generic and descriptive sense only and not for purposes of limitation. Moreover, the present disclosure has been described in detail, it should be understood that various changes, substitutions and alterations can be made thereto without departing from the spirit and scope of the disclosure as defined by the appended claims. Accordingly, the present disclosure is not limited to the specific embodiments illustrated herein, but is limited only by the following claims.

What is claimed:

1. A hand held drum positioned between a thumb and fingers to generate sound, the drum comprising:

a drum shell having an external surface and internal surface and configured with two apertures, said two apertures having a first aperture and a second aperture;

a spring mount affixed thereto said drum shell;

a striker element;

a spring having first spring end releasably affixed thereto said spring mount and a second spring end affixed to said striker element;

two heads, each one of said two heads stretched taught across one of said two apertures, said each one of said two heads having an inside head surface, wherein said striker element is configured to strike said inside head surface of said two heads; and a handgrip removeably affixed to said drum shell, said handgrip includes a first grip end gripped by the thumb and a second grip end gripped by the fingers.

2. The drum of claim 1, wherein said drum shell is formed as a cylinder.

3. The drum of claim 1, wherein said two apertures further comprises a top shell opening having a first rim and a bottom shell opening having a second rim.

4. The drum of claim 1, wherein said drum shell further comprises one or more shell holes configured to enable the sound to escape said drum shell.

5. The drum of claim 1, wherein said first spring end further comprises a shaped bend formed therein said first spring end.

6. The drum of claim 3, wherein said first rim of said top shell opening further comprises a first head stretched taught thereto and said second rim of said bottom shell opening further comprises a second head stretched taught thereto.

7. The drum of claim 6, wherein said first head and said second head are configured as soft heads for practice play.

8. The drum of claim 6, wherein said first head and said second head are configured as hard heads for volume play.

9. The drum of claim 1, wherein the thumb is positioned pointing up holding said drum at an angle.

10. The drum of claim 1, wherein said spring mount further comprises a first spring mount affixed to said external surface and a second spring mount affixed to said internal surface.

11. The drum of claim 1, wherein said spring mount further comprises an adjustment mechanism configured to provide a length adjustment between said striker element and said internal surface.

12. The drum of claim 6, wherein said drum is configured to travel in an arc motion.

13. The drum of claim 12, wherein said first head further and said second head further comprises a first inside head surface and a second inside head surface.

14. The drum of claim 13, wherein said striker element is configured to travel in an arc motion between said first inside head surface and said second inside head surface.

15. The drum of claim 1, wherein said spring configured with a bend formed therein.

16. The drum of claim 1, wherein said striker element is positioned centered between said two heads.

17. A method of generating a rhythm from a hand held drum positioned between a thumb and fingers, said method comprising the steps of:

providing a drum having a drum shell having an external surface and internal surface and configured with two apertures, said two apertures having a first aperture and a second aperture, a spring mount affixed thereto said drum shell, a striker element, a spring having first spring end releasably affixed thereto said spring mount and a second spring end affixed to said striker element, two heads, each one of said two heads stretched taught across one of said two apertures, said each one of said two heads having an inside head surface, wherein said striker element is configured to strike said inside head surface of said two heads, a handgrip removeably affixed to said drum shell, said handgrip having a first grip end and a second grip end;

gripping said drum, wherein said first grip end gripped by the thumb and said second grip end gripped by the fingers;

shaking said drum in an arc motion, wherein said striker element travels in said arc motion striking said inside head surface; and producing a drum beat on each strike of said striker element thereon said inside head surface.

18. The method of claim 17, wherein said spring mount further comprises an adjustment mechanism configured to provide a length adjustment between said striker element and said internal surface.

19. The method of claim 18, further comprising the step of adjusting said length adjustment between said striker element and said internal surface to vary a speed of said drum beat.

20. The method of claim 17, wherein shaking said drum in said arc motion produces a double strike of said drum beat.

21. The method of claim 17, wherein shaking said drum in said arc motion produces a 32nd note rhythm of said drum beat.

22. The method of claim 17, wherein shaking said drum in said arc motion produces a rhythm of said drum beat comprising a group consisting of a ¼ note, a ⅛ note, a 1/16 note, a 1/32 note, a drum roll, and combinations thereof.

* * * * *